US005993159A

United States Patent [19]

Mack

[11] Patent Number: 5,993,159

[45] Date of Patent: Nov. 30, 1999

[54] PULL CORD DEFLECTOR

[76] Inventor: Jackie B. Mack, P.O. Box 15003, Tallahassee, Fla. 32317-5003

[21] Appl. No.: 08/743,025

[22] Filed: Nov. 4, 1996

[51] Int. Cl.[6] ..... F04D 29/32

[52] U.S. Cl. ..... 416/146 R; 416/5; 200/331; 200/543; 362/96; 362/394; 362/370

[58] Field of Search ..... 416/5, 170 R, 416/146 R; 200/52 R, 331, 543; 362/96, 294, 404, 370, 394, 251; 248/308, 339

[56] References Cited

U.S. PATENT DOCUMENTS

| | | | |
|---|---|---|---|
| 2,195,582 | 4/1940 | Schoenberg | 362/394 |
| 2,382,823 | 8/1945 | Schoenberg | 362/394 |
| 2,581,185 | 1/1952 | Gordon | 416/5 |
| 3,771,309 | 11/1973 | Peters . | |
| 4,241,249 | 12/1980 | Chundelak, Jr. . | |
| 4,657,485 | 4/1987 | Hartwig | 416/5 |
| 4,899,050 | 2/1990 | Cianflone . | |
| 4,954,939 | 9/1990 | Hutchins . | |
| 5,339,618 | 8/1994 | Sawyer . | |
| 5,379,407 | 1/1995 | Bogdan . | |
| 5,388,710 | 2/1995 | Sawyer . | |
| 5,624,230 | 4/1997 | Taylor et al. | 416/5 |

*Primary Examiner*—Christopher Verdier
*Attorney, Agent, or Firm*—Carnes, Cona and Dixon

[57] ABSTRACT

A pull cord deflector is comprised of a plate, having a channel, that is positioned between a ceiling fan housing and a switch locking nut. An extension arm is hingedly attached to the plate. The notched end of the extension arm is dimensioned to terminate beyond the periphery of a light globe of the ceiling fan. One or more optional springs extend between the plate and the extension arm.

20 Claims, 3 Drawing Sheets

PULL CORD DEFLECTOR

BACKGROUND OF THE INVENTION

1. Field of the Invention

The present invention relates to a pull cord deflector, typically used with ceilings having a light globe extending downwardly therefrom, and more particularly to a pull cord deflector for orienting a pull cord away from the light globe for avoiding contact between the light globe and pull cord for inherently preventing damage and injury to the globe.

2. Background of the Prior Art

Ceiling fans are manufactured in one of two general varieties—with or without attached lights. In ceiling fans having lights, the light extends downwardly from the centrally located fan housing. Typically a single light is covered by a globe. These ceiling fans normally have two pull-type cords, one cord for controlling fan power and speed and a second cord for controlling light activation. These cords emanate from the fan housing and hang downwardly across the light globe. Whenever one of the cords is pulled downwardly in order to activate its respective device, the cord is rubbed against the light globe. If sufficient pull force is exerted onto the cord, the cord can shatter the glass globe. Not only is this breakage financially and aesthetically undesirable, but as the user is typically looking upward toward the fan in order to pull the cord, the breakage has the potential to cause serious eye injury to the user. Even without eye injury, broken glass is an unwanted condition in any house.

A second problem associated with current pull cords is their tendency to break after repeated use. The cord rubs against its respective locking nut and in time breaks at the rubbing point.

Therefore, there is a need in the art for a device that prevents light globe breakage whenever a fan cord is pulled. The device must steer the pull cord off of the globe, yet must permit full functionality of the cord. Furthermore, the device must prevent the cord from rubbing against the locking nut. The device must be of simple and straightforward design and must be capable of being retrofitted onto existing ceiling fans.

SUMMARY OF THE INVENTION

The pull cord deflector of the present invention addresses the aforementioned needs in the art. The pull cord deflector provides a device that allows full functionality of the fan pull cords that hang from a ceiling fan yet prevents cord contact with the light globe of the fan. The device also prevents friction contact between the pull cord and its locking nut. The device is of simple and straightforward construction that can be mounted onto existing fans.

The pull cord deflector of the present invention is comprised of a plate and an extension arm. The plate includes a channel which can be either open or closed. In the open position, the channel will have a U-shape configuration while in a closed position, the channel will be an aperture. This channel will receive the conventional pull cord of the existing fan or light source.

The extension arm includes a first end and a second end. The first end or inner end is hingedly secured to the plate and the second end or outer end can be notched. This notched end receives the pull cord.

With respect to the plate, maintaining the extension arm outwardly is accomplished by the use of at least one spring. In this arrangement, one end of the spring(s) is secured to plate while the opposite end is secured to the extension arm. This will provide for the spring(s) to be sandwich between the plate and extension arm.

The pull cord deflector of the present invention can easily be attached to existing ceiling fans such that the plate is positioned above the light globe. For securing the pull cord deflector to the fan, the existing switch locking nut is removed. This removal will expose an existing opening within fan housing. The existing pull chain, which is attached to the switch, extends outwardly from the opening. To attach the device of the present invention, the channel is aligned with this opening and the switch locking nut is inserted into the channel and re-inserted into the opening. The pull cord is pass through the channel and the switch locking nut is threadably secured to provide for the plate to be attached to the fan housing. In this configuration, the extension arm extends outwardly from the fan housing. The pull cord that extends outwardly from the switch locking nut is passed along the length of the extension arm and is received within the notch and thereafter hangs downwardly. The extension arm is of sufficient length so that the downward hanging pull cord hangs clear of the light globe. The spring assure proper positioning of the extension arm when a relatively heavy pull cord ca-bob is located on the end of the cord.

The device prevents contact between the cord and the light globe thereby eliminating the potential for globe breakage whenever force is exerted on the cord. The device also orients the pull cord outwardly such that there is no rubbing contact between the pull cord and the edge of the locking nut thereby eliminating friction breakage potential. The device is of simple and straightforward design and is quickly and easily installed onto existing ceiling fans.

Accordingly, it is the object of the present invention to provide for a pull cord deflector to be used in combination with a conventional pull cord and which will overcome the deficiencies, drawbacks and shortcomings of the method for utilizing such a cord.

Yet another object of the present invention is to provide a pull cord deflector which will prevent contact between an existing light globe and pull cord, typically associated with ceiling fans, for inherently preventing damage to the globe, or possibly to the user.

Still another object of the present invention to be specifically enumerated herein, is to provide a pull cord deflector in accordance with the preceding objects and which will conform to conventional forms of manufacture, be of simple construction and easy to use so as to provide a device that would be economically feasible, long lasting and relatively trouble free in operation.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENT

Figure 1:
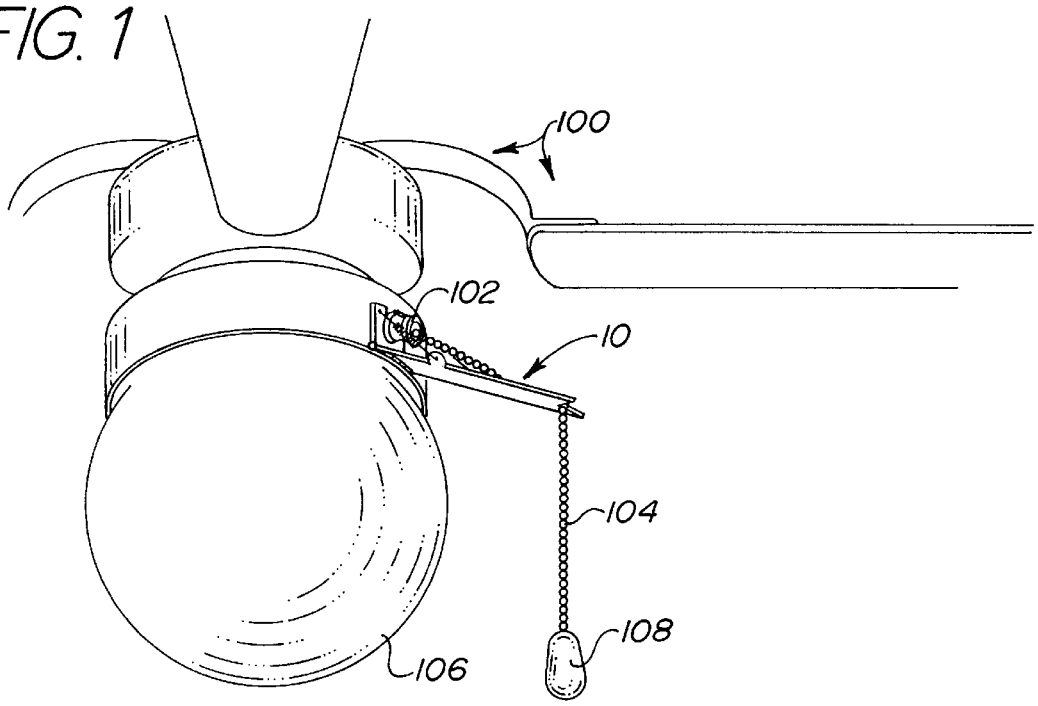
FIG. 1 is a perspective view of the pull cord deflector of the present invention installed on a ceiling fan.
Figure 2:
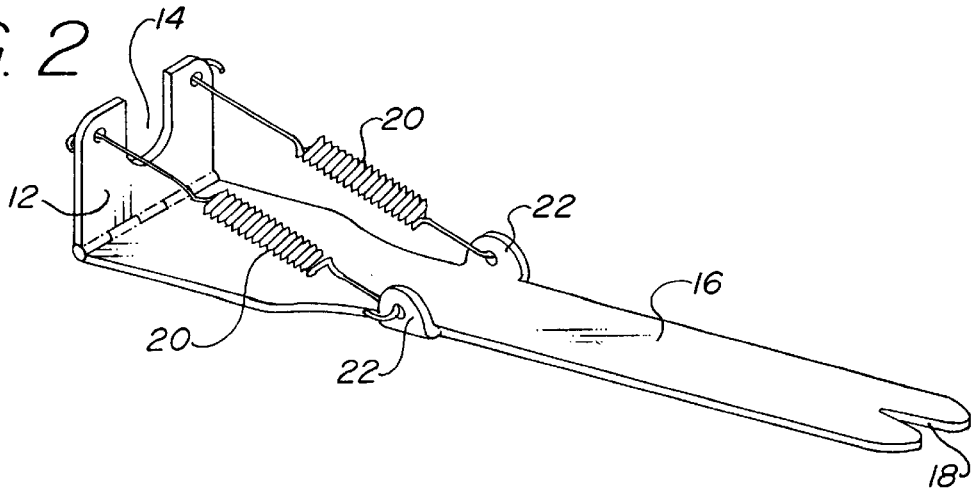
FIG. 2 is a perspective view of the pull cord deflector.
Figure 5:
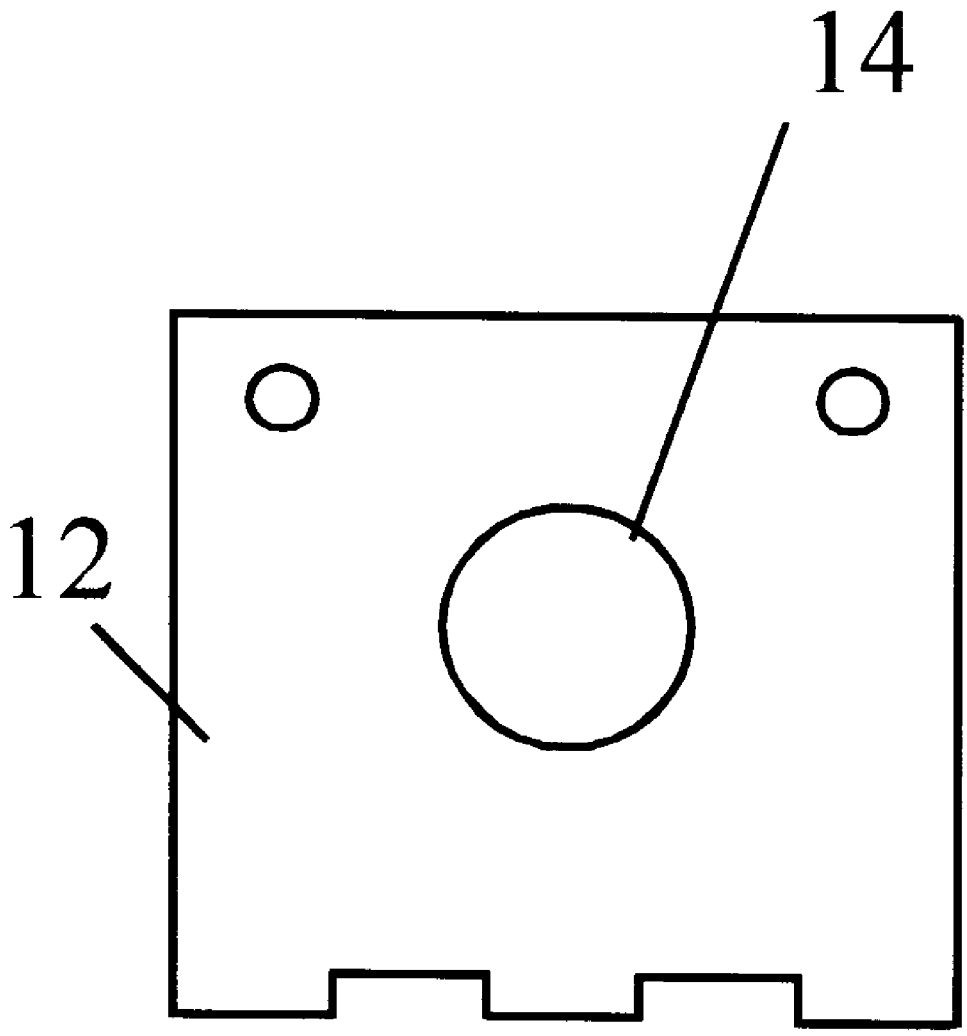
FIG. 5 is a front view of the plate used with the pull cord deflector of the present invention, illustrating a closed channel.

Referring now to the drawings, it is seen that the pull cord deflector, generally denoted by reference numeral 10, is comprised of a plate 12. As seen, the plate 12 has a channel 14 located thereon. The channel 14 can be either open, as illustrated in FIGS. 1 and 2, or closed as illustrated in FIG. 5. Hence, it is seen that in the open position the channel is U-shaped while in the closed position, the channel is an aperture. An extension arm 16, having an inner end and an outer end, is hingedly attached to the plate 12. This attachment occurs at the inner end of the extension arm, thereby and as seen, this provides for the inner end to be hingedly secured to the plate 12. The outer end of the extension arm 16 can have a notch 18.

For more stability, and as illustrated in FIGS. 1–4 one or more springs 20 extend between the plate 12 and the extension arm 16. The one or more springs can be attached directed to the extension arm 16, or alternately to flanges 22 on the extension arm. The one or more springs 20 can attach to the plate 12 in any appropriate fashion. This configuration of the springs, and as illustrated, will offer more structural stability of the extension arm 16 to the plate 12. The use of springs 20 will maintain the extension arms in an extended position and outward position, with respect to the plate 12. This arrangement is clearly shown in the drawings.

In order to utilize the pull cord deflector 10 of the present invention, the switch locking nut 102 is threadably loosened or removed from the ceiling fan 100. The plate 12 is positioned such that the fan cord 104 passes through the channel 14. If the channel 14 is open, simple loosening of the switch locking nut 102 is required and the plate 12 is slid up into place. If the channel 14 is closed, the switch locking nut 102 must be removed and the fan cord 104 must be passed through the channel 14 in order to position the plate 12 into place.

Thereafter, the switch locking nut 102 is threadably retightened in order to secure the plate 12 between the switch locking nut 102 and the fan housing 100. The fan cord 104 is passed along the length of the extension arm 16 with a portion of the fan cord 104 frictionally secured within the notch 18.

Figure 3:
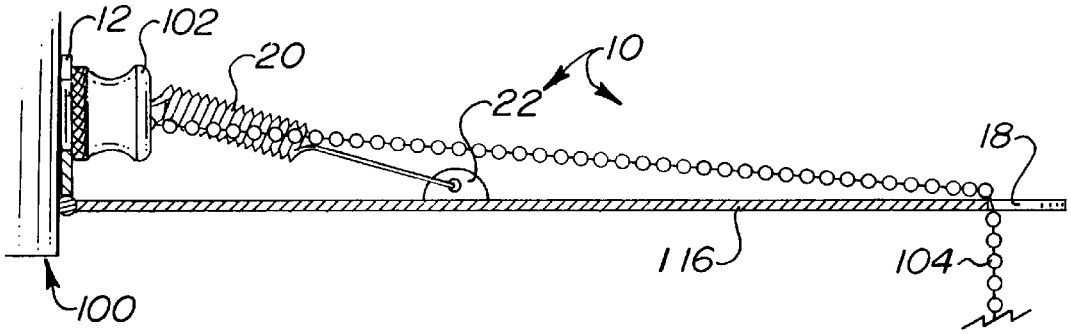
FIG. 3 is a partial sectional side elevation view of the pull cord deflector in a normally relaxed stated.
Figure 4:
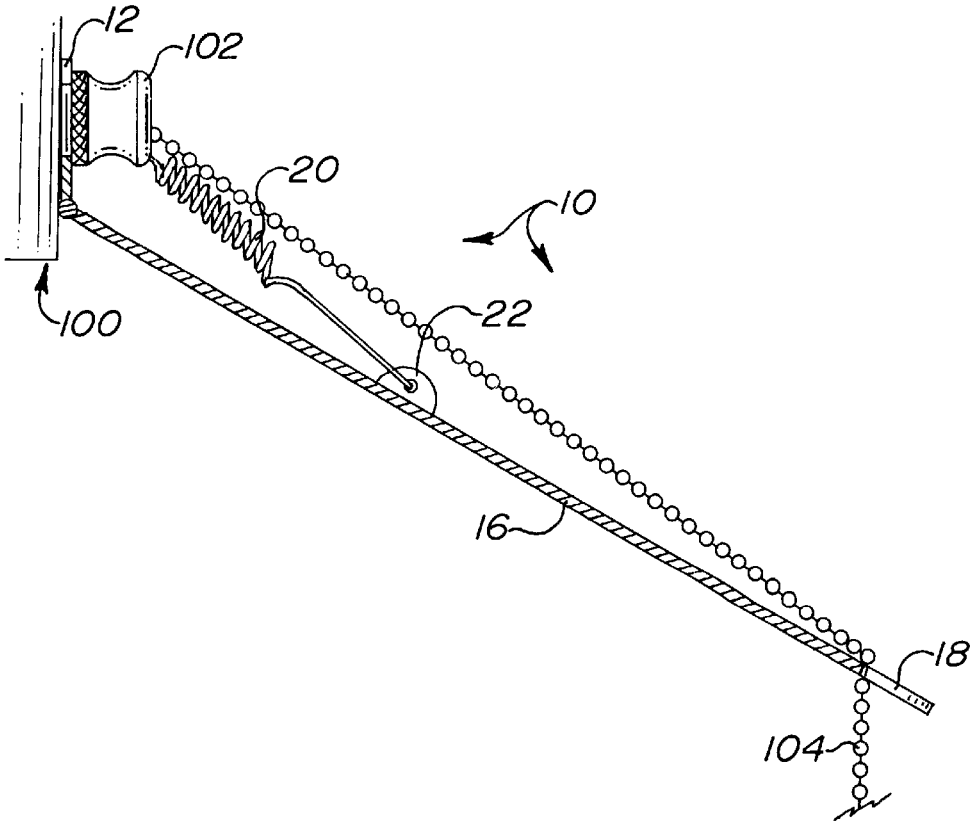
FIG. 4 is a partial sectional side elevation view of the pull cord deflector in an extended stated.

In this position, illustrated in FIG. 3, the extension arm 16 extends outwardly from the ceiling fan 100 in a generally horizontal configuration and thus is in a normally relaxed state. The extension arm 16 is of sufficient length so that the fan cord 104 hangs gravitationally downward from the notched end of the extension arm 16 clear of the light globe 106 of the ceiling fan.

A user may grab of the end of the fan cord 104 in order to perform the desired action of the ceiling fan 100. Downward pull of the fan cord 104 will cause a corresponding downward articulation of the extension arm 16 (illustrated in FIG. 4).

Once the user releases the fan cord 104, the spring action of the fan switch (not illustrated) causes upward articulation of the fan cord 104. As the fan cord 104 is secured within the notch 18 of the extension arm 16, the upwardly articulating fan cord 104 causes upward articulation of the extension arm 16. If the spring action of the fan switch lacks sufficient force to cause upward articulation of the extension arm 16, as when a relatively heavy ca-bob or tassel 108 is attached to the end of the fan cord 104, the optional one or more springs assist the spring action of the fan switch in returning the fan cord 104 and the extension arm 16 into the relaxed state.

While the invention has been particularly shown and described with reference to an embodiment thereof, it will be understood by those skilled in the art that various changes in form and detail may be made without departing from the spirit and scope of the invention.

I claim:

1. A pull cord deflector for orienting a pull cord generally outwardly and away from a fan light globe, said pull cord deflector comprising:

a plate, having a channel, positioned between a fan body and a switch locking nut;

an extension arm having a first end hingedly attached to said plate and a second end that is notched;

at least one spring being connected between said plate and said extension arm.

2. A pull cord deflector as in claim 1 wherein said channel is open.

3. A pull cord deflector as in claim 1 wherein said channel is closed.

4. A pull cord deflector as in claim 1 further comprising:

one or more flanges located on the extension arm; and one each of said one or more springs connected between one of the one or more flanges and said plate.

5. A pull cord deflector in combination with a fixture having a pull cord attached thereto, said pull cord deflector will orient the pull cord generally outwardly and away from the fixture, said pull cord deflector comprising:

a plate located between a fixture housing and a switch locking nut;

an extension arm having an inner end and an outer end, said inner end is attached to said plate;

said plate has a channel, said channel cooperates with said switch locking nut for providing said plate to be secured to said housing via said switch locking nut and said plate will be located between and contact said housing and said switch locking nut;

said pull cord extending outwardly from said housing and through said channel and through said switch locking nut; and said pull cord extends from said inner end of said extension arm and to said outer end.

6. A pull cord deflector as in claim 5 wherein said outer end of said extension arm is notched for receiving said pull cord.

7. A pull cord deflector as in claim 5 wherein said channel is open.

8. A pull cord deflector as in claim 5 wherein said channel is closed.

9. A pull cord deflector as in claim 5 wherein said inner end is hingedly secured to said plate.

10. A pull cord deflector as in claim 9 wherein said outer end is notched.

11. A pull cord deflector as in claim 5 wherein at least one spring is connected between said plate and said extension arm.

12. A pull cord deflector as in claim 10 wherein at least one spring is connected between said plate and said extension arm.

13. A pull cord deflector as in claim 12 wherein at least one flange is located on said extension arm and each spring is between one of said at least one flange and said plate.

14. A pull cord deflector in combination with a ceiling fan having a fixture, said fixture and/or said ceiling fan having a pull cord attached thereto, said pull cord deflector will orient the pull cord generally outwardly and away from the fixture, said pull cord deflector comprising;

a plate located between a fan housing and a switch locking nut;

an extension arm having an inner end and an outer end, said inner end is hingedly attached to said plate;

said plate having a channel, said channel cooperates with said switch locking nut for providing said plate to be secured to said housing via said switch locking nut and said plate will be located between and contact said housing and said switch locking nut;

said pull cord extending outwardly from said housing and through said channel and through said switch locking nut; and said pull cord extends from said inner end of said extension arm and to said outer end.

15. A pull cord deflector as in claim 14 wherein said second end of said extension arm is notched.

16. A pull cord deflector as in claim 14 wherein at least one spring is connected between said plate and said extension arm.

17. A pull cord deflector as in claim 16 wherein at least one flange is located on said extension arm and each spring is between one of said at least one flange and said plate.

18. A pull cord deflector as in claim 14 wherein said channel is open.

19. A pull cord deflector as in claim 14 wherein said channel is closed.

20. A pull cord deflector as in claim 15 wherein said channel is open.

* * * * *